US012178297B2

(12) United States Patent
Retrouvey et al.

(10) Patent No.: US 12,178,297 B2
(45) Date of Patent: Dec. 31, 2024

(54) WRISTLET WITH LINKS MADE OF A HARD MATERIAL

(71) Applicant: Comadur SA, Le Locle (CH)

(72) Inventors: Sébastien Retrouvey, Chissey sur Loue (FR); Anthony Tapiz-Delgado, Noel Cerneux (FR)

(73) Assignee: Comadur SA, Le Locle (CH)

( * ) Notice: Subject to any disclaimer, the term of this patent is extended or adjusted under 35 U.S.C. 154(b) by 79 days.

(21) Appl. No.: 18/163,985

(22) Filed: Feb. 3, 2023

(65) Prior Publication Data

US 2024/0000201 A1 Jan. 4, 2024

(30) Foreign Application Priority Data

Jun. 30, 2022 (EP) ..... 22182358

(51) Int. Cl.
*A44C 5/08* (2006.01)

(52) U.S. Cl.
CPC ..... *A44C 5/08* (2013.01)

(58) Field of Classification Search
CPC ..... G04B 37/1486; G04B 37/18; G04B 37/0008; A44C 5/105; A44C 5/107; A44C 5/02; A44C 5/08
See application file for complete search history.

(56) References Cited

U.S. PATENT DOCUMENTS 421,136 A * 2/1890 Kerckhoffs ..... A44C 5/107 63/4
1,445,564 A * 2/1923 Stafford ..... A44C 5/105 59/80
1,995,517 A * 3/1935 Neugass ..... A44C 5/2071 63/3
6,079,196 A 6/2000 Linder et al.
2015/0250272 A1* 9/2015 Moille ..... F16B 33/002 29/525.11
2021/0015221 A1* 1/2021 Tan ..... A44C 5/2061

FOREIGN PATENT DOCUMENTS

WO WO 98/08408 A1 3/1998

OTHER PUBLICATIONS

European Search Report issued Nov. 15, 2022 in European Application 22182358.6 filed on Jun. 30, 2022 (with English Translation of Categories of cited documents).

* cited by examiner

*Primary Examiner* — Jack W Lavinder
(74) *Attorney, Agent, or Firm* — Oblon, McClelland, Maier & Neustadt, L.L.P.

(57) ABSTRACT

A wristlet including a first row with at least one central link, a second row and a third row disposed respectively on either side of the first row and each including at least one lateral link, a connecting rod positioned in the three aligned holes of the first, second and third rows, wherein the connecting rod includes a shoulder, and wherein each hole of the central link opens at one of its ends onto a hollow formed in the central link, the hollow being delimited by a first wall and by a second wall serving as a first banking and as a second banking for the shoulder when the central link pivots about the connecting rod so as to limit the amplitude of rotation of the central link about the connecting rod.

16 Claims, 5 Drawing Sheets

WRISTLET WITH LINKS MADE OF A HARD MATERIAL

CROSS-REFERENCE TO RELATED APPLICATION

This application claims priority to European Patent Application No. 22182358.6 filed on Jun. 30, 2022, the entire disclosure of which is hereby incorporated herein by reference.

TECHNICAL FIELD OF THE INVENTION

The invention relates to a wristlet formed by elements that are hinged together, in particular by links at least some of which are made of a hard material. It also relates to a piece, including a timepiece such as a watch or a jewellery piece, comprising said wristlet.

TECHNOLOGICAL BACKGROUND

In the watchmaking or jewellery making industry, various materials are used for the manufacture of wristlets with various appearances. In particular, it is known to manufacture wristlets made of a hard material. By hard material, it should be understood the materials having a Vickers hardness higher than 1,200 HV. For example, these hard materials are ceramic such as silicon nitride, zirconium oxide or aluminium oxide. It may also consist of ceramels. Hard materials are used for their mechanical properties, in particular because they are hardly scratched.

The disadvantage of these materials is their fragility with an increased risk of breakage during machining of the links and when these move, or collide, relative to each other during handling of the wristlet.

SUMMARY OF THE INVENTION

The present invention aims to overcome the aforementioned drawbacks by providing an assembly between the links allowing controlling the amplitude of rotation of the links so as to avoid collisions.

For this purpose, the connecting rods that connect the different rows of links of the wristlet include a shoulder which it fits into a hollow formed in the links of the central row. This hollow is delimited by two bankings which limit the angular movement of the links of the central row relative to the connecting rod.

More specifically, the present invention relates to a wristlet comprising:

- a first row with at least one central link provided with two open-through holes, said holes of the central link,
- a second row and a third row disposed respectively on either side of the first row, the second row and the third row each comprising at least one lateral link, said lateral link being provided with two holes, called holes of the lateral link, with a hole of the lateral link of the second row aligned on a hole of the central link of the first row and on a hole of the lateral link of the third row to form a set with three aligned holes,
- a connecting rod positioned in the three aligned holes, said connecting rod being fixedly mounted with respect to the lateral link of the second row and of the third row and forming an axis around which the central link is pivotally mounted, the wristlet being characterised in that the connecting rod comprises a shoulder, and in that each hole of the central link opens at one of its ends onto a hollow formed in said central link, said hollow being delimited by a first so-called internal wall as it is the closest to the centre of the central link and by a second so-called external wall as it is the furthest from the centre of the central link, the first wall and the second wall serving as a first banking and second banking for the shoulder when the central link pivots about the connecting rod so as to limit the amplitude of rotation of said central link about the connecting rod.

Thus, according to the invention, the axes serving as junctions and pivots between the links are used to limit the amplitude of rotation of the links and absorb all or part of the stresses upon abutment. These axes are protected from the outside by the links and can therefore be made of a material that is less hard and therefore less fragile than the links. Thus, hey can be easily shaped by machining to make the shoulders which allow controlling the amplitude of rotation.

Moreover, the central link includes a protruding portion, also called coverage area, which extends in the second and third rows between the lateral links. This protruding portion of the central link as well as the lateral link have a particular shape which confers an aesthetic touch on the wristlet without any contact between the protruding portion and the lateral links when the central link pivots. This absence of contact allows avoiding stressing of the links made of the hard material.

To conclude, the assembly of the wristlet according to the invention allows controlling the extent of movability of the links of a wristlet made of a hard material with a design including coverage areas in order to ensure solidity thereof while avoiding collisions or stressing of fragile portions made of a hard material during handling thereof.

Further features and advantages of the present invention will become apparent in the following description of a preferred embodiment, given by way of non-limiting example with reference to the appended drawings.

DETAILED DESCRIPTION OF THE INVENTION

Figure 1:
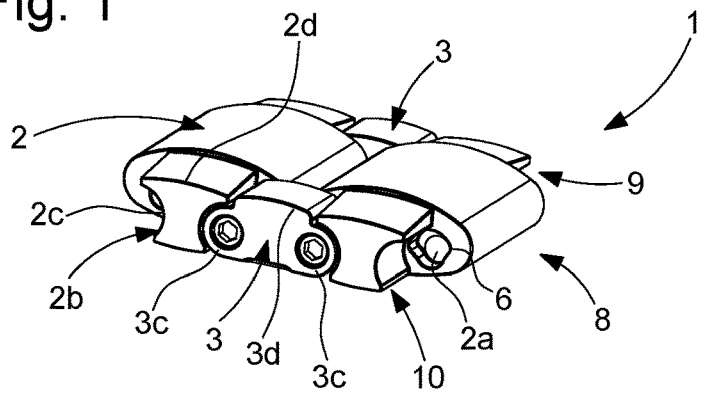
FIG. 1 is a three-dimensional partial view of the wristlet according to the invention.

The present invention relates to a wristlet 1 comprising at least three rows of links with a first row 8 comprising the central links 2 and, a second row 9 and a third row 10 on either side of the first row 8 comprising the lateral links 3.

A partial view of this wristlet 1 with two adjacent central links 2 and two lateral links 3 is represented in FIG. 1. For example, this wristlet is intended to equip a timepiece such as a watch or a jewellery piece. More specifically, the assembly as described hereinafter is suited for a wristlet some links of which are at least partially made of a hard material. By hard material, it should be understood a material whose hardness is substantially equal to or higher than 1,200 HV and which withstands little plastic deformation, or not at all, before breaking up. As a hard material, mention may be made, without limitation, of enamels, stones, precious or not, such as ruby, sapphire or quartz, ceramics such as an oxide, a carbide or a nitride, ceramels or hard metals. It should be noted that although the assembly is specifically suited for links made of a hard material, it also applies for links made of more ductile materials.

Figure 2A:
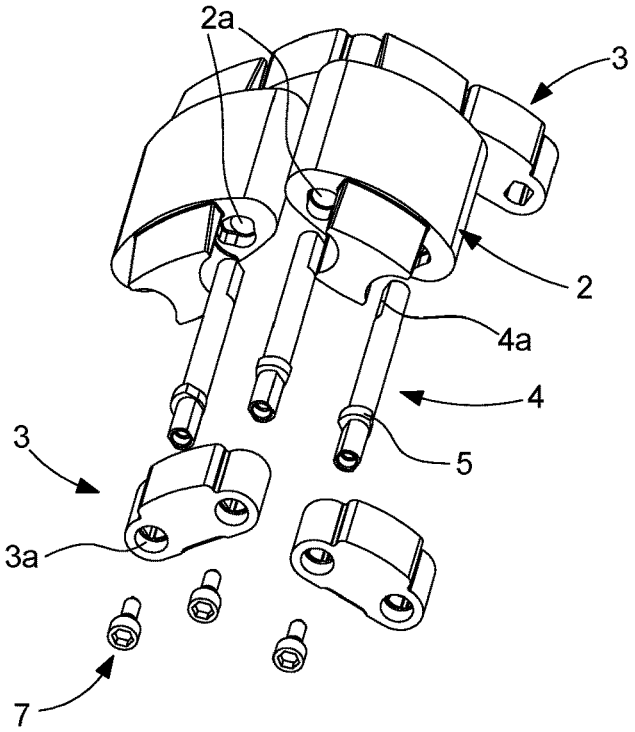
FIGS. 2A and 2B are exploded and three-dimensional partial views of the wristlet according to the invention.
Figure 3:
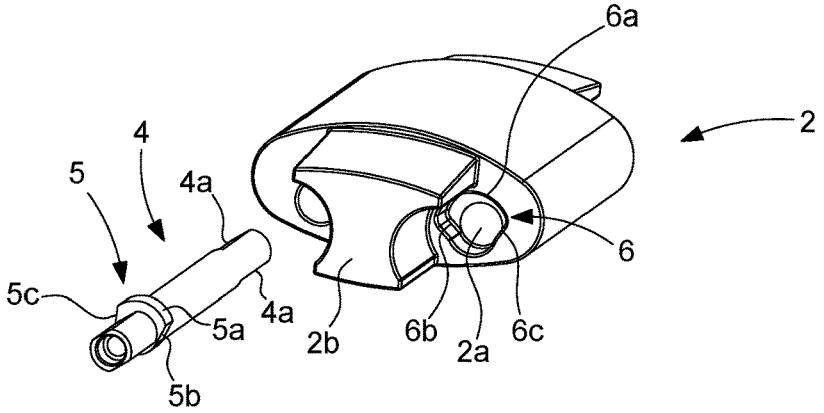
FIG. 3 is a three-dimensional view of the central link and of the connecting rod according to the invention.
Figure 4A:
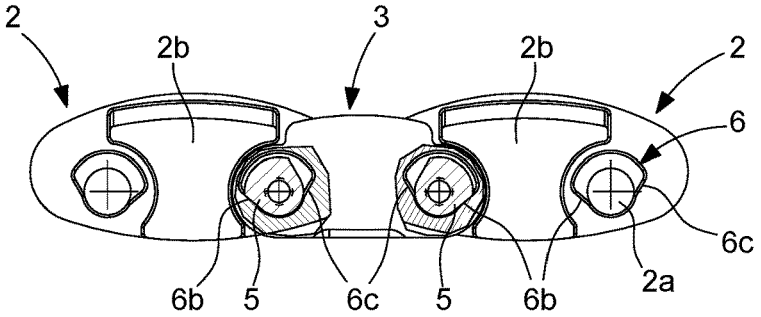
FIGS. 4A and 4B are partial sectional views of a portion of the wristlet respectively in the flat position and in the pivoted position.
Figure 4B:
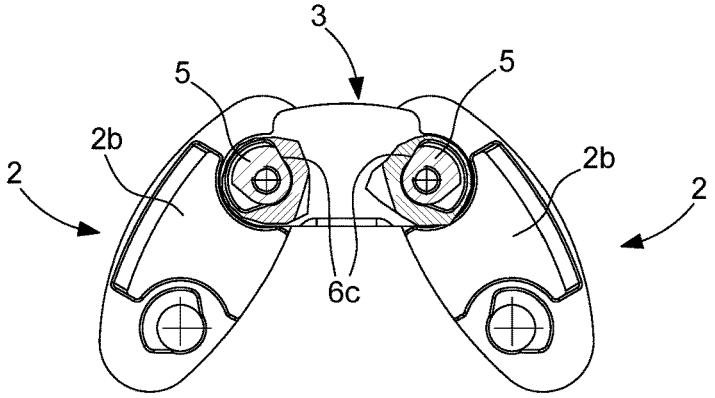
Figure 6A:
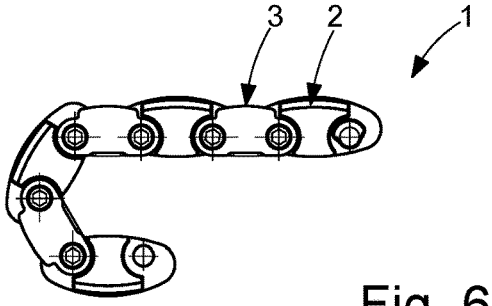
FIG. 6A is a side view of the wristlet in the pivoted position.
Figure 6B:
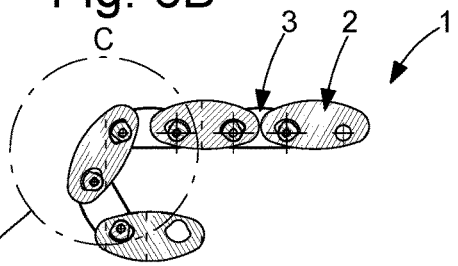
FIG. 6B is a sectional view of FIG. 6A with an enlargement C in FIG. 6C.
Figure 6C:
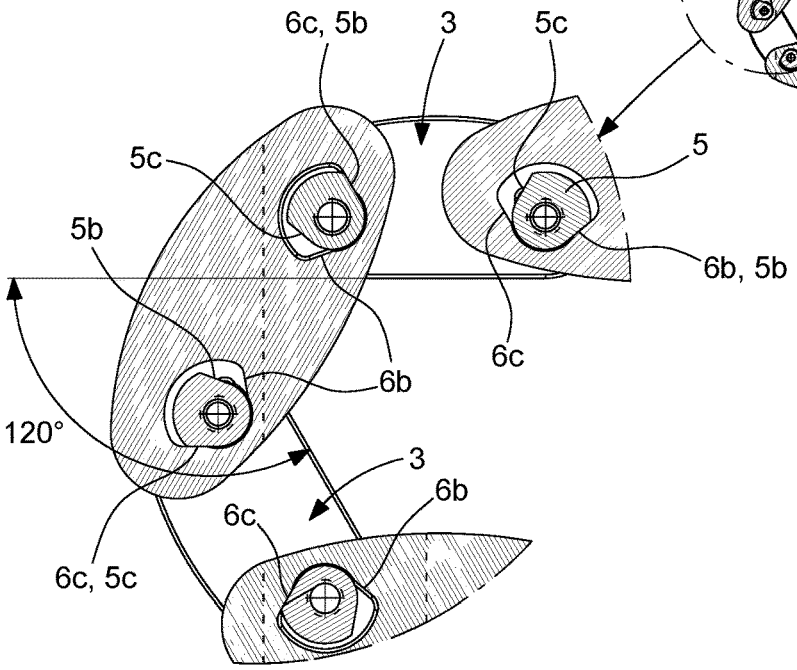

According to the invention and as illustrated in FIGS. 4B and 6C, the amplitude of rotation of the central links 2 is limited. For this purpose, the connecting rod 4 between the central link 2 and the two lateral links 3 includes a shoulder 5 abutting against the walls 6*b*, 6*c* of a hollow 6 formed in the central link 2, when the central link 2 pivots (FIGS. 2A and 3). Advantageously, the connecting rod is made of a less hard material such as a steel or a titanium alloy to facilitate machining. Typically, the material of the connecting rod has a hardness lower than 1,200 HV.

Figure 8:
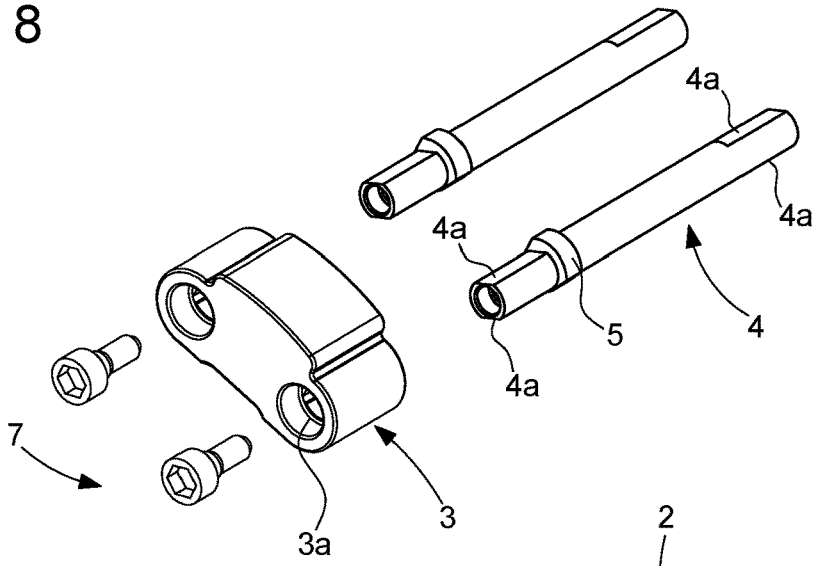
FIGS. 8 to 11 are views of a portion of the wristlet during assembly.
Figure 9:
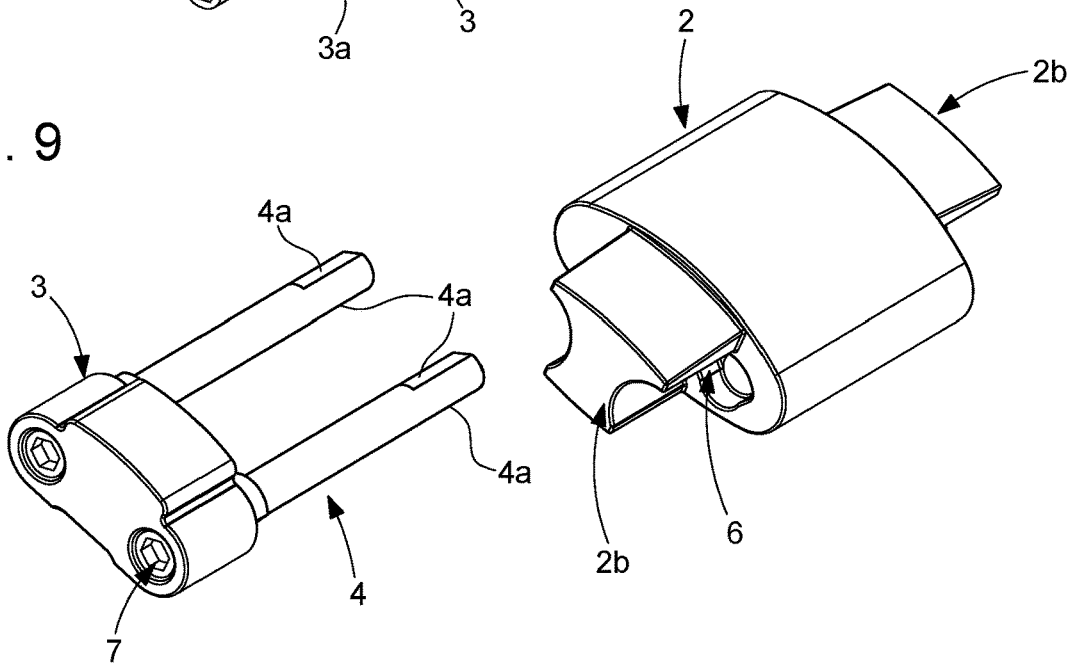

In a known manner, the central link 2 includes two open-through holes 2*a* each intended to receive the connecting rod 4, which are also referred to as axis, and each of the lateral links 3 includes two blind or open-through holes 3*a* to accommodate the end of the connecting rod 4 (FIGS. 2A and 8). According to the invention, the open-through holes 2*a* of the central link 2 open onto the hollow 6 formed in the central link 2 and that being so only at one end of each open-through hole (FIG. 3). In each central link, the hollow for the two open-through holes can be formed on the same face of the central link as represented in FIG. 2A or respectively for an open-through hole on a face of the central link and for the other open-through hole on the other face of the central link like for the assembly of FIG. 2B.

Figure 2B:
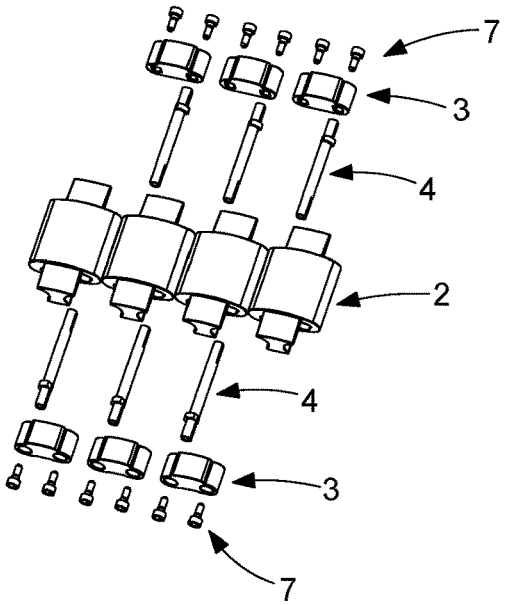
Figure 7:
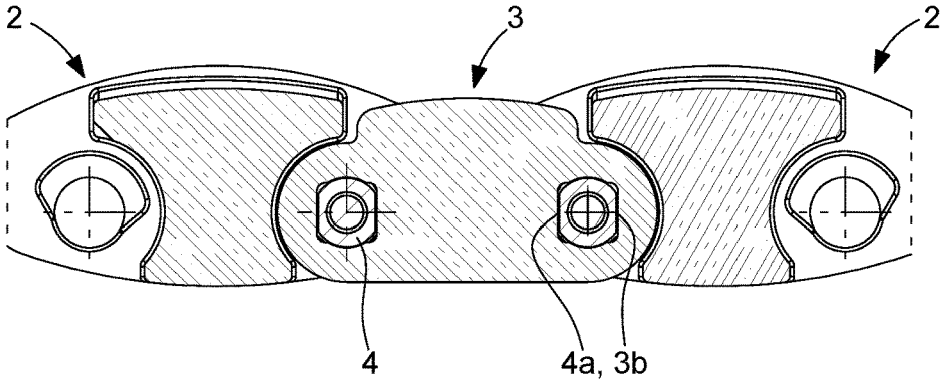
FIG. 7 is a partial sectional view of the wristlet according to the invention.

According to the invention, the connecting rod 4 is secured to the lateral link 3 and the central link 2 has a rotational relative movement relative to this block secured around the axis formed by the connecting rod. To secure the connecting rod and the lateral link, there are several possibilities. Preferably, the connecting rod has a portion with a non-circular section at each of its ends which is positioned in a portion of the blind or open-through hole of the lateral link provided with a non-circular section too. For example, the portion with a non-circular section of the connecting rod includes at least one flat surface which is positioned against a plane inside the hole of the lateral link. In the illustrated example, the portion with a non-circular section of the connecting rod 4 includes two flat surfaces 4*a*, for example diametrically opposite, which are positioned against two planes 3*b* which delimit the blind or open-through hole 3*a* of the lateral link 3 (FIGS. 3 and 7). Fastening of the connecting rod 4 within the lateral link 3 may be achieved using a screw 7 which is positioned at one end of the hole 3*a* which in this case is open-through as represented in FIGS. 2A and 2B. Fastening could also be achieved by gluing within the blind or open-through hole of the lateral link. Alternatively, fastening of the connecting rod within the hole of the lateral link could simply be achieved by gluing without requiring a portion with a non-circular section at the ends of the connecting rod.

The amplitude of the relative rotational movement between the connecting rod 4 and the central link 2 is limited by the shoulder 5 of the connecting rod 4 which bears either on the first banking 6*b*, or on the second banking 6*c* of the hollow 6 of the central link 2 according to pivoting of the latter. Preferably, the shoulder 5 flares radially as a circle arc from the connecting rod 4. The circle arc 5*a* is connected to the connecting rod 4 by a first flank 5*b* and a second flank 5*c* which bear on the first banking 6*b* or on the second banking 6*c* (FIG. 3). The first banking 6*b* is formed by the innermost wall of the hollow, i.e. the closest one to the centre of the central link, in contrast with the second banking 6*c* which is formed by the outermost wall with respect to the centre of the central link. Preferably, the two connecting rods and their shoulder are arranged within the hollows of the central link so as to bend the wristlet in a direction inwards of the wristlet as illustrated in FIG. 6A. For this purpose, within the central link, the two connecting rods are positioned angularly in a different manner in the two open-through holes. In the flat position, the shoulder 5 for the two connecting rods 4 bears on the internal wall 6*b* of the hollow 6 (FIG. 4A). Thus, for a connecting rod, it is the first flank 5*b* which bears on the internal wall 6*b* of the hollow and for the other connecting rod, it is the second flank 5*c* which bears on the internal wall 6*b* of the hollow (FIG. 5C). In the fully pivoted position, the shoulder 5 of the two rods bears on the external wall 6*c* of the hollow 6 (FIG. 4B). Thus, for a connecting rod, it is the second flank 5*c* which bears on the external wall 6*c* of the hollow and for the other connecting rod, it is the first flank 5*b* which bears on the external wall 6*c* of the hollow (FIG. 6C). The hollow 6 formed at the end of the open-through hole also flares as a circle arc with the circle arc 6*c* of the hollow 6 having a length larger than that of the circle arc 5*a* of the shoulder 5 to enable pivoting of the latter within the hollow. The length of the circle arc of the hollow in comparison with that of the circle arc of the shoulder allows defining the extent of angular movement of the central link relative to the connecting rod. Typically, the amplitude of rotation of the central link relative to the connecting rod is smaller than or equal to 150°, preferably smaller than or equal to 60°. In the illustrated example, each central link 2 has an amplitude of rotation of 60°, which, after rotation of two adjacent central link by 60°, allows having a pivoting by 120° between two adjacent lateral links 3 as schematised in FIGS. 5C and 6C.

Figure 5A:
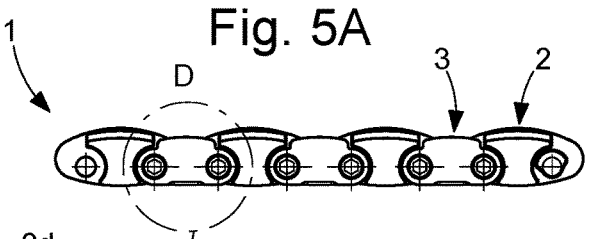
FIG. 5A is a side view of the wristlet in the flat position with an enlargement D in FIG. 5D.
Figure 5D:
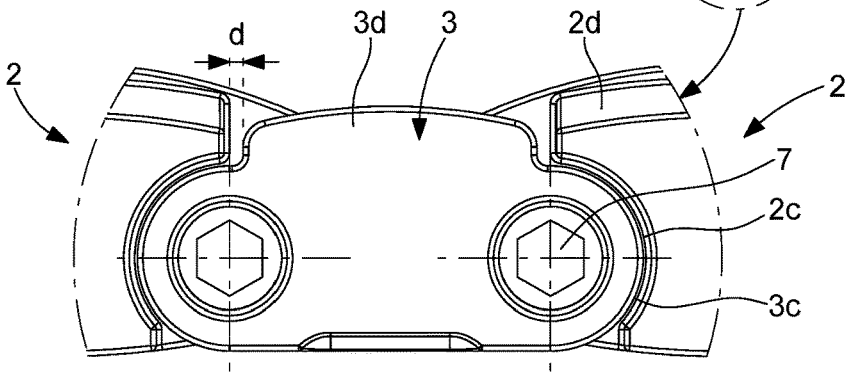
FIG. 5B is a sectional view of FIG. 5A with an enlargement C in FIG. 5C.
Figure 5B:
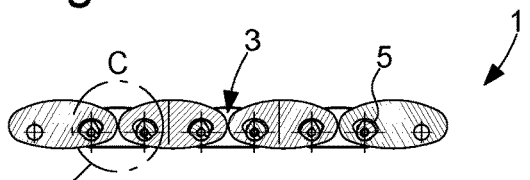
Figure 5C:
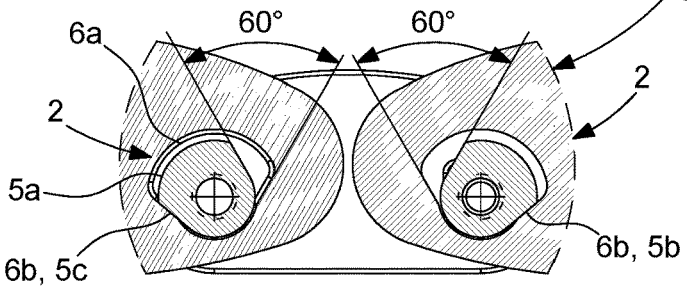
Figure 11:
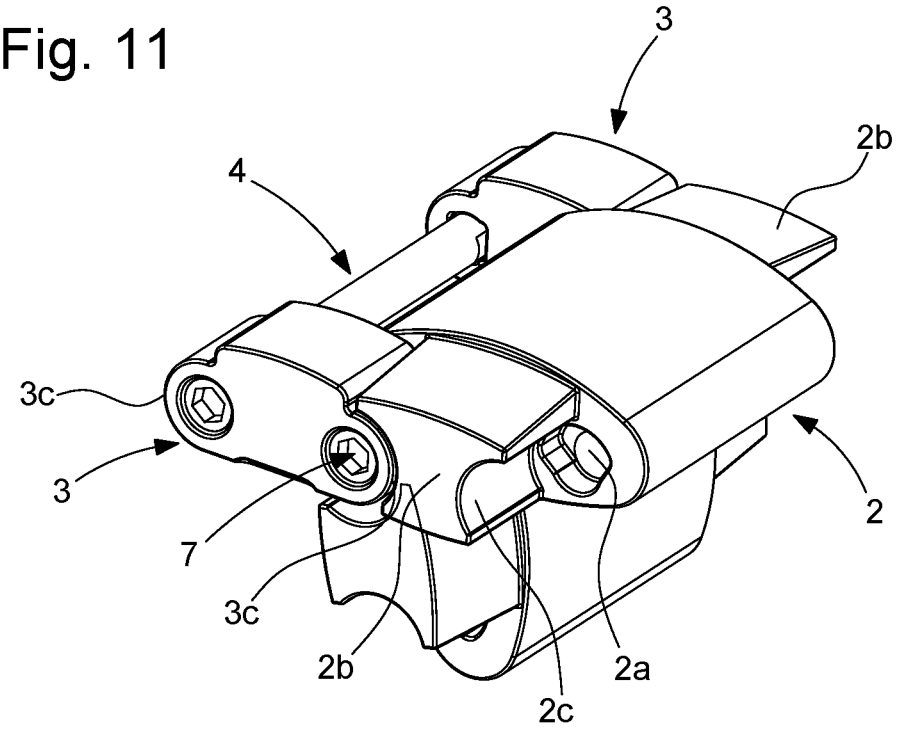

Preferably, the lateral links 3 have two circular lugs 3*c* which are positioned in a circular recess 2*c* formed in a protruding portion 2*b* of the central link 3 disposed between the two open-through holes 2*a* (FIGS. 5D and 11). The protruding portion 2*b* of the central link 2 is interposed between two lateral links 3 to form respectively the second row 9 and the third row 10 with the lateral links 3 (FIG. 1). Typically, the protruding portion 2*b* of the central link 2 has a thickness substantially equal to that of the lateral link 3. The lugs 3*c* of the lateral links 3 fit without contact within the circular recess 2*c* of the protruding portion 2*b* of the central links. The lugs 3*c* of the lateral link are topped by a portion 3*d* setback with respect to these (FIG. 5D). This setback portion 3*d* is positioned without contact opposite the top 2*d* of the protruding portion 2*b* which hangs over the recess 2*c*. The space d between the top 2*d* of the protruding portion 2*b* and the setback portion 3*d* of the lateral link 3 is observed in FIG. 5D. Positioning is done without contact to avoid stressing the hard material.

Figure 10:
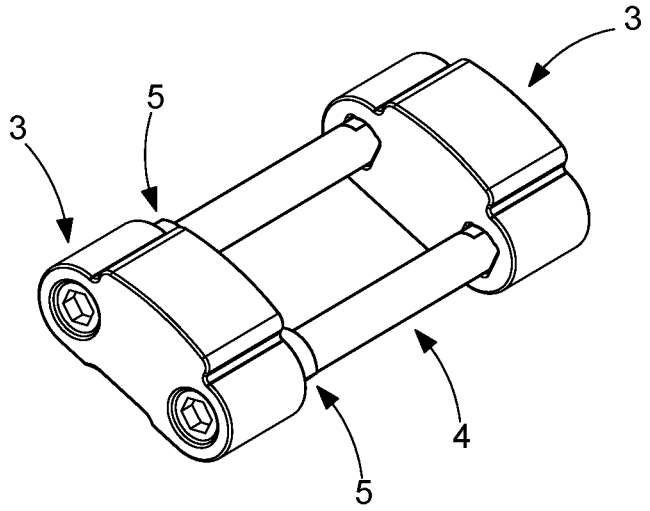

The assembly of the different elements of the wristlet is done as follows. It may be carried out like in FIG. 2A with all hollows of the central links which are formed on the same face of the link, therefore with all connecting rods provided with the shoulder which are introduced via this face. It may also be carried out like in FIG. 2B with a hollow formed alternately on one face and on the other face of the central link, the connecting rod being introduced with this same alternation. The assembly principle is substantially the same in both cases and described in connection with FIGS. 2A and 8 to 11. FIG. 10 shows a simplified view where the central link is absent.

The two connecting rods 4, and more specifically the portion with the flat surfaces 4*a*, are mounted in the respective holes 3*a* of the lateral link 3 with the shoulder 5 of the connecting rod 4 which is positioned with an axial clearance opposite the lateral link 3. Fastening between the connecting rods 4 and the lateral link 3 is performed using screws 7 which are introduced into one end of the open-through hole 3*a* of the lateral link up to the recessed portion of the connecting rod. Alternatively, fastening may be performed by gluing. Afterwards, a central link 2 is fitted onto one of the connecting rods 4 with the shoulder 5 which fits with an axial clearance into the hollow 6 of the central link 2 and bears on the internal wall 6*b* of the hollow. Similarly, a central link 2 is fitted onto the other connecting rod 4 of the lateral link 3 still with the shoulder which bears on the internal wall of the hollow. Lastly, the other end of the two connecting rods provided with the flat surfaces is introduced into a lateral link and fastening is performed with the two screws or by gluing. And so on, the entire wristlet is assembled.

KEY

1. Wristlet
2. Central link
  a. Open-through hole
  b. Protruding portion
  c. Circular recess
  d. Top of the protruding portion
3. Lateral link
  a. Open-through or blind hole
  b. Plane
  c. Circular lug
  d. Setback portion
4. Connecting rod
  a. Flat surface
5. Shoulder
  a. Circle arc
  b. First flank
  c. Second flank
6. Hollow, also called pocket, of the central link
  a. Circle arc
  b. Second banking, also called internal wall or first wall
  C. Second banking, also called external wall or second wall
7. Screw
8. First row
9. Second row
10. Third row

The invention claimed is:

1. A wristlet comprising:

a first row with a central link provided with first and second open-through holes, a second row and a third row disposed respectively on either side of the first row, the second row and the third row each comprising a lateral link being provided with first and second holes, with the first hole of the lateral link of the second row aligned on the first open-through hole of the central link of the first row and on the first hole of the lateral link of the third row to form a set with three aligned holes, a connecting rod positioned in the three aligned holes, said connecting rod being fixedly mounted with respect to the lateral link of the second row and of the third row and forming an axis around which the central link is pivotally mounted, wherein the connecting rod comprises a shoulder, and wherein the first and second open-through holes of the central link each opens at an end thereof onto a hollow formed in said central link, said hollow being delimited by a first internal wall located closer to a center of the central link and by a second external wall located further from the center of the central link, the first internal wall and the second external wall respectively forming a first banking and second banking for the shoulder when the central link pivots about the connecting rod so as to limit an amplitude of rotation of said central link about the connecting rod.

2. The wristlet according to claim 1, wherein the shoulder of the connecting rod flares radially as a circle arc from the connecting rod, the circle arc being connected to the connecting rod by a first flank and a second flank, and wherein the hollow has a shape flaring as a circle arc with a length of said circle arc larger than that of the circle arc of the shoulder to enable pivoting of the shoulder within the hollow.

3. The wristlet according to claim 1, wherein the amplitude of rotation of the central link about the connecting rod is smaller than or equal to 150°.

4. The wristlet according to claim 1, wherein when the central link has a zero amplitude of rotation such that the central link of the first row and the lateral link of the second row and lateral link of the third row are in the same plane, the shoulder bears on the first internal wall of the hollow and wherein when the central link has reached a maximum amplitude of rotation, the shoulder bears on the second external wall of the hollow.

5. The wristlet according to claim 1, wherein each end of the connecting rod has a portion with a non-circular section at, and wherein each hole of each lateral link has a portion with a non-circular section, the portion with a non-circular section of the connecting rod fitting into the portion with a non-circular section of the hole of each lateral link so that the connecting rod is fixedly mounted with respect to each lateral link.

6. The wristlet according to claim 5, wherein the portion with a non-circular section of the connecting rod comprises a flat surface which bears on a plane of the portion with a non-circular section of each lateral link.

7. The wristlet according to claim 1, wherein each end of the central link between the first and second open-through holes comprises a protruding portion which extends in the second row and in the third row next to each lateral link.

8. The wristlet according to claim 7, wherein the protruding portion of the central link has a thickness substantially equal to that of each lateral link.

9. The wristlet according to claim 7, wherein each lateral link comprises two circular lugs with a circular lug which fits without contact into a circular recess formed in the protruding portion of the central link.

10. The wristlet according to claim 1, wherein the first and second holes of each lateral link are open-through holes, and wherein fastening between each lateral link and the connecting rod is achieved with a screw which is positioned at an end of the one of the first and second open-through holes on a side opposite to the central link.

11. The wristlet according to claim 1, wherein the first and second holes of each lateral link are open-through or blind, and wherein fastening between each lateral link and the connecting rod is achieved with a glue.

12. The wristlet according to claim 1, wherein at least one of the central link and each lateral link is at least partially made of a material with a hardness that is equal to or higher than 1,200 HV.

13. The wristlet according to claim 1, wherein the connecting rod has a hardness lower than 1,200 HV.

14. The wristlet according to claim 1, wherein the hollow of the central link for the first and second open-through holes is formed on a same face of the central link.

15. The wristlet according to claim 1, wherein the hollow of the central link for the first and second open-through holes is respectively formed on a face of the central link for the first open-through hole and on an opposite face of the central link for the second open-through hole.

16. A timepiece, comprising the wristlet according to claim 1.

* * * * *